United States Patent [19]

Hake

[11] Patent Number: 4,858,415

[45] Date of Patent: Aug. 22, 1989

[54] METHOD AND APPARATUS FOR UNITIZING TIRES

[75] Inventor: Leroy Hake, Louisville, Ky.

[73] Assignee: Lantech, Inc., Louisville, Ky.

[21] Appl. No.: 253,583

[22] Filed: Oct. 5, 1988

[51] Int. Cl.[4] ..... B65B 11/30; B65B 13/20; B65B 27/06; B65B 63/02

[52] U.S. Cl. ..... 53/438; 53/441; 53/529; 53/556; 53/587

[58] Field of Search ..... 53/204, 211, 214, 380, 53/399, 409, 436, 438, 441, 442, 528, 529, 556, 587

[56] References Cited

U.S. PATENT DOCUMENTS

| | | | |
|---|---|---|---|
| 1,354,371 | 9/1920 | Angier | 53/528 X |
| 2,363,751 | 11/1944 | Schultz et al. | 53/204 |
| 3,149,446 | 9/1964 | Hood | 53/211 X |
| 3,955,491 | 5/1976 | McMahon | 53/529 X |
| 4,152,879 | 5/1979 | Shulman | 53/211 X |
| 4,235,062 | 11/1980 | Lancaster, III et al. | 53/441 X |
| 4,450,668 | 5/1984 | Grossi | 53/587 X |
| 4,502,264 | 3/1985 | Flaherty | 53/587 X |
| 4,607,476 | 8/1986 | Fulton, Jr. | 53/587 X |
| 4,718,219 | 1/1988 | Schmitz | 53/211 X |
| 4,735,033 | 4/1988 | Stackhouse | 53/399 |
| 4,747,252 | 5/1988 | Kapke | 53/441 |

*Primary Examiner*—Robert L. Spruill
*Assistant Examiner*—Beth Bianca
*Attorney, Agent, or Firm*—Finnegan, Henderson, Farabow, Garrett & Dunner

[57] ABSTRACT

A method and apparatus for unitizing a load of tires stacked in a longitudinal direction. The stack of tires is compressed in the longitudinal direction between two platens located adjacent the ends of the stack of tires. A web is dispensed and stretched along the direction in which it is dispensed. A leading end portion of the web is held adjacent the stack of tires and mandrels are positioned adjacent the ends of the stack of tires. The stack of tires is rotated relative to the web dispenser about its longitudinal axis. The stretched web is wrapped around and onto the compressed stack of tires and the mandrels, forming a tube which extends in the longitudinal direction beyond the stack of tires and on the mandrels. The mandrels are separated from the web and the stack of tires and the web is collapsed from the mandrel onto the stack of tires, covering the sidewalls of the tires at the ends of the stack.

20 Claims, 4 Drawing Sheets

METHOD AND APPARATUS FOR UNITIZING TIRES

BACKGROUND OF THE INVENTION

The present invention relates to unitizing stacks of tires. Conventionally, tires are packaged for transport by stacking them coaxially and banding them with four straps. As shown in FIG. 1, each strap runs axially along the outside of the stack of tires, across the sidewall of one end tire, up through the aligned center hole of the tires, and across the sidewall of the other end tire. If the straps are insufficiently tightened, the tires are not held together securely. Conversely, if the straps are tightened to hold the stack of tires together securely, the tires are damaged because the bead of the tires becomes creased and fails to form a tight seal when mounted on a tire rim. Tires held together with straps scuff and get dirty, especially on the sidewalls located at the end of each stack. The straps hang up on forklift trucks used to transport these stacks of tires and create disposal problems after removal from the tires.

People have attempted to unitize stacks of tires by axially compressing the stack and stretch wrapping it with a web of stretch film. An example of a stretch wrapping process and apparatus is shown in U.S. Pat. No. 4,735,033, which is incorporated herein by reference. Previous attempts at stretch wrapping a stack of tires were unsatisfactory because the tires would uncontrollably collapse when the stack was compressed, or the tires would become dislodged from the wrapped stack when the stack was jolted or positioned on its side to form a horizontal array.

Accordingly, it is object of the present invention to provide a method and apparatus for unitizing load of tires which would hold the stack of tires together securely without damaging the tires.

It is also an object of the present invention to provide a method and apparatus for unitizing a stack of tires in which the tires would be prevented from being scuffed and getting dirty during transport.

It is another object of the present invention to provide a method and apparatus for unitizing a stack of tires in which the packaging would not interfere with transporting the stack of tires on a forklift or create problems of disposal.

It is an additional object of the present invention to provide a method and apparatus for unitizing a stack of tires in which a stack of tires could be transported in a manner in which they occupy the least amount of volume during transport without being damaged.

Additional objects and advantages of the invention will be set forth in the description which follows, and in part will be obvious from the description, or may learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention is embodied and broadly described herein, there is provided an apparatus for unitizing a load of tires stacked in a longitudinal direction. The apparatus includes means for dispensing a web and means for stretching the web along the direction in which it is dispensed. There also is means for rotating the stack of tires relative to the web dispensing means about an axis in the longitudinal direction, wrapping the stretched web around and onto the compressed stack of tires and forming a tube from the web with portions of the tube extending in the longitudinal direction beyond the ends of the stack of tires. In addition, there is provided mandrel means positioned adjacent the ends of the stack of tires for supporting and compressing the stack of tires in the longitudinal direction, for supporting the portions of the tube which extend in the longitudinal direction beyond the stack of tires during wrapping, and for subsequently moving relative to the tube and the stack of tires to allow the tube to collapse on the ends of the stack of tires, covering the sidewall of the tires at the ends of the stack.

There is also provided a method of unitizing a load or tires stacked in a longitudinal direction. The method includes compressing the stack of tires in the longitudinal direction between platens located adjacent the ends of the stack of tires. A web is dispensed and stretched along the direction in which it is dispensed. Mandrels are positioned adjacent the ends of the stack of tires. The stack of tires is rotated relative to the web dispenser about an axis in the longitudinal direction, wrapping the stretched web around and onto the compressed stack of tires and the mandrels, forming a tube from the web which extends in the longitudinal direction beyond the stack of tires and on the mandrels. The mandrels are separated from the web and stack of tires and the web is collapsed from the mandrels onto the end of the stack of tires covering the sidewall of the tires at the ends of the stack.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIG. 9 is a side elevational view of a portion of the stretch wrapping device shown in FIGS. 3–8 with an additional mandrel and platen for accommodating a stack of tires having a different diameter.

DESCRIPTION OF THE PREFERRED EMBODIMENT

Reference will now be made in detail to the present preferred embodiment of the invention as illustrated in the accompanying drawings.

Figure 3:
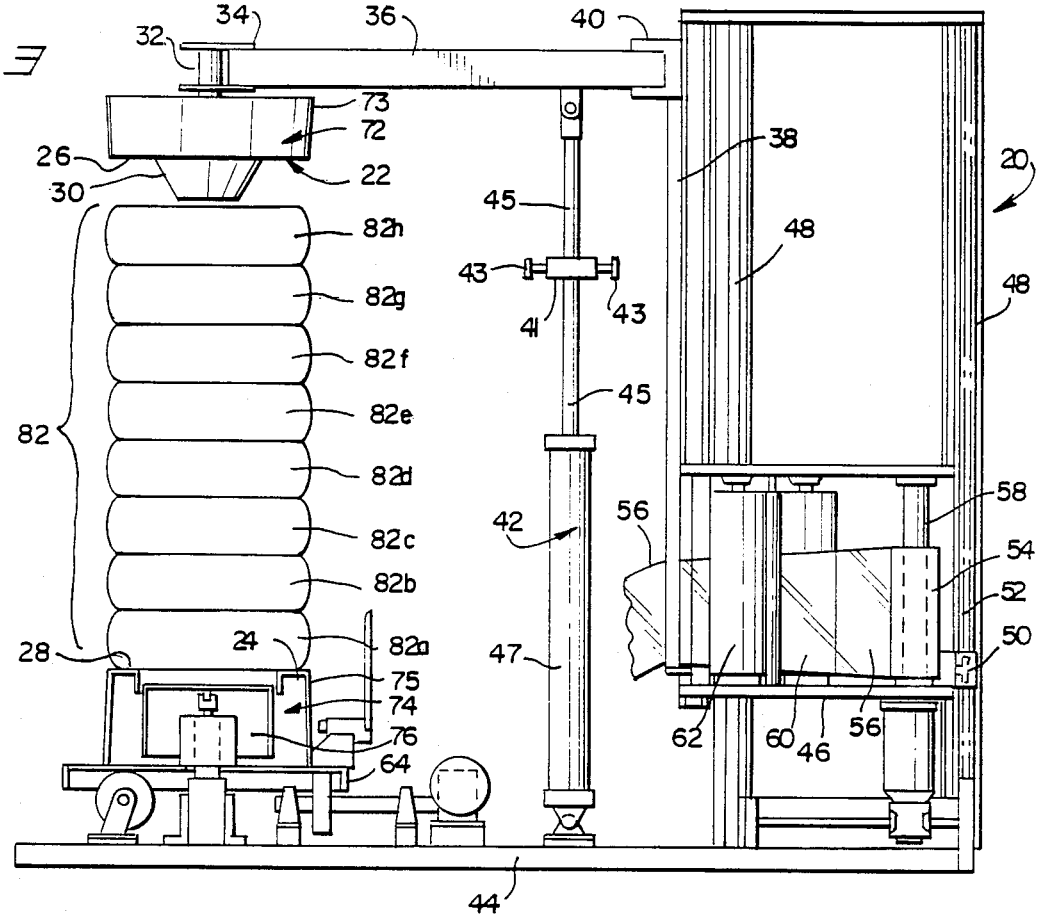
Figure 4:
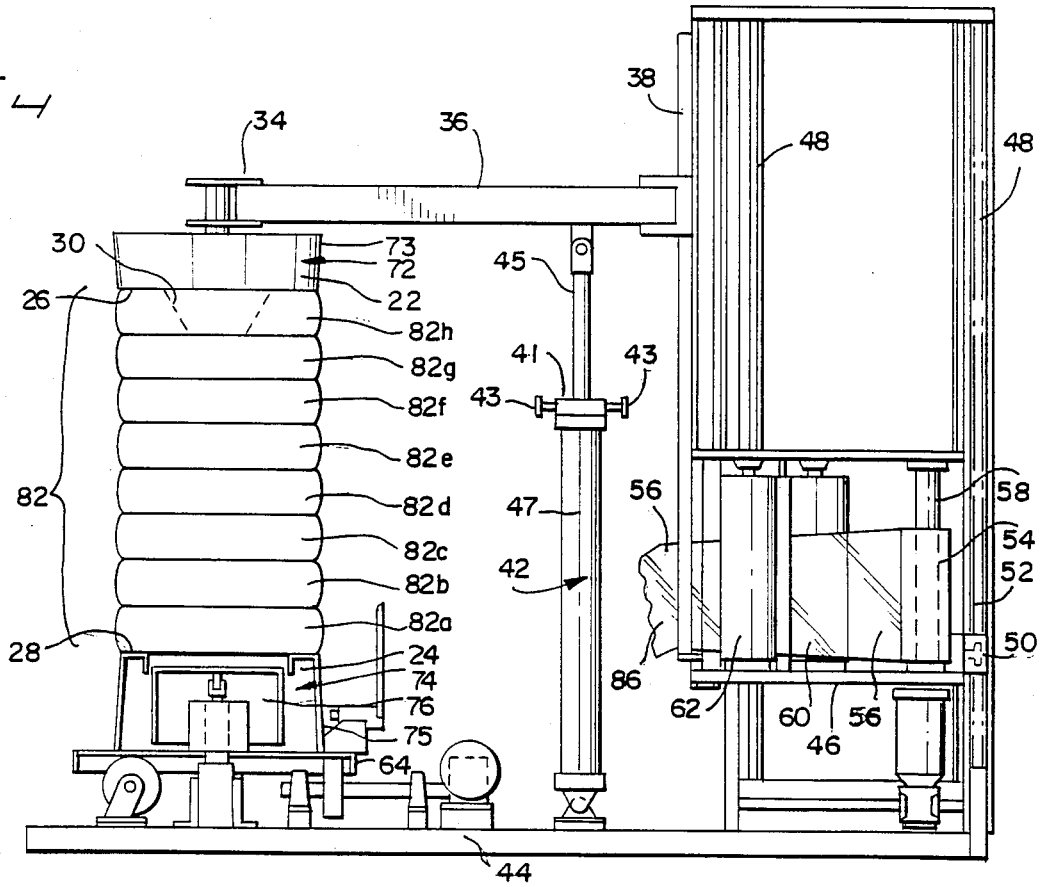

In accordance with the present invention there is provided an apparatus for unitizing a load of tires stacked in a longitudinal direction. As shown in FIG. 3, the apparatus for unitizing tires includes a stretch wrapping device 20.

According to the present invention, there is provided means for dispensing a web and means for stretching the web along the direction in which it is dispensed. As shown in FIG. 3, the dispensing means includes a film roll carriage 46, which is supported by posts 48 and movably positioned in the vertical direction by a motor driven pinion 50 on film roll carriage 46 which engages a rack 52 on at least one of posts 48. Film roll carriage 36 includes a roll 54 of stretch film 56 in the form of a web. Film roll 54 is mounted on spindle 58 which is attached to film roll carriage 46.

The means for stretching the web include upstream prestretch roller 60 and downstream prestretch roller 62 which are coupled together so that downstream prestretch 62 rotates at a faster rate of speed than upstream prestretch roller 60 and thereby stretches the film in the direction in which it is dispensed. Other methods of stretching the web of stretch film 56 may also be used. For example, the film roll 54 may be restrained by a brake.

Figure 5:
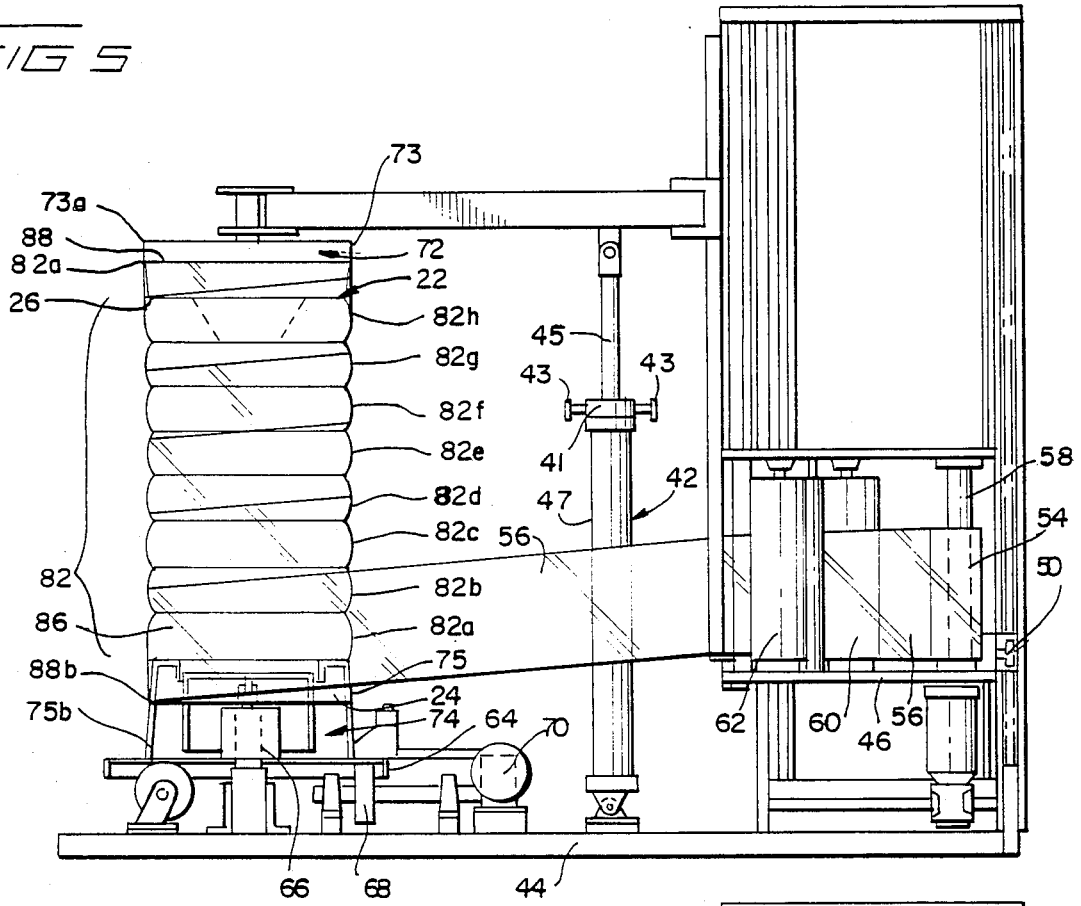

According to the present invention there is provided means for rotating the stack of tires relative to the web dispensing means about an axis in the longitudinal direction, wrapping the stretched web around and onto the compressed stack of tires and forming a tube from the web, with portions of the tube extending in the longitudinal direction beyond the ends of the stack of tires. As shown in FIG. 5, the means for rotating and wrapping includes turntable 64 which is mounted onto base 44 vertical axle 66 so that turntable 64 rotates about a vertical axis. Turntable 64 is rotatably driven by drive wheel 68 which engages its under surface. Drive wheel 68 is powered by motor and geared speed reducer 70. Lower platen 24 is fastened to turntable 64 and rotates with turntable 64. The means for rotating the stack of tires relative to the web dispensing means alternatively may include an arrangement in which the stack of tires is stationary relative to the ground and the film roll is moved around the stack of tires.

According to the present invention, there is provided mandrel means positionable adjacent the ends of the stack of tires for supporting and compressing the adjacent end of the stack of tires in the longitudinal direction, for supporting the portions of the tube which extend in the longitudinal direction beyond the ends of the stack of tires during wrapping, and for subsequently moving relative to the tube and the stack of tires to allow the tube to collapse on the ends of the stack of tires, covering the sidewall of the tires at the ends of the stack.

As shown in FIG. 3, the mandrel means includes upper mandrel 72 and lower mandrel 74. A portion of upper mandrel 72 forms a frusto-conical mandrel surface 73 which extends generally in the vertical direction yet tapers convergently toward the stack of tires. Mandrel surface 73 supports a portion of the tube which extends beyond the upper ends of the stack of tires during wrapping.

Another portion of upper mandrel 72 includes upper platen 22. Upper platen 22 includes an annular downwardly facing platen surface 26 for supporting and compressing the stack of tires from the top end. Upper mandrel 72 also includes a central frusto-conical surface 30 which faces outward and downward to help support and center the stack of tires 82.

Upper mandrel 72 is suspended by a central vertical axle 32 which allows upper mandrel 72 to rotate about a vertical axis. Axle 32 is attached by clevis 34 to one end of a horizontal beam 36. The other end of horizontal beam 36 is slidably attached to vertical post 38 by brace 40. An intermediate portion of horizontal beam 36 is attached to the upper end of a vertical piston and cylinder 42. The other end of the piston and cylinder 42 is attached to base 44 of stretch wrapping device 20.

A portion of lower mandrel 74 forms a frusto-concial mandrel surface 75 which extends generally in the vertical direction yet tapers convergently toward the stack of tires. Mandrel surface 75 supports a portion of the tube which extends beyond the lower end of the stack of tires during wrapping. Another portion of lower mandrel 74 includes lower plated 24. Lower platen 24 includes an annular upwardly facing platen surface 28 which is aligned with downwardly facing platen surface 26 for supporting and compressing the stack of tires from the bottom end.

Figure 6:
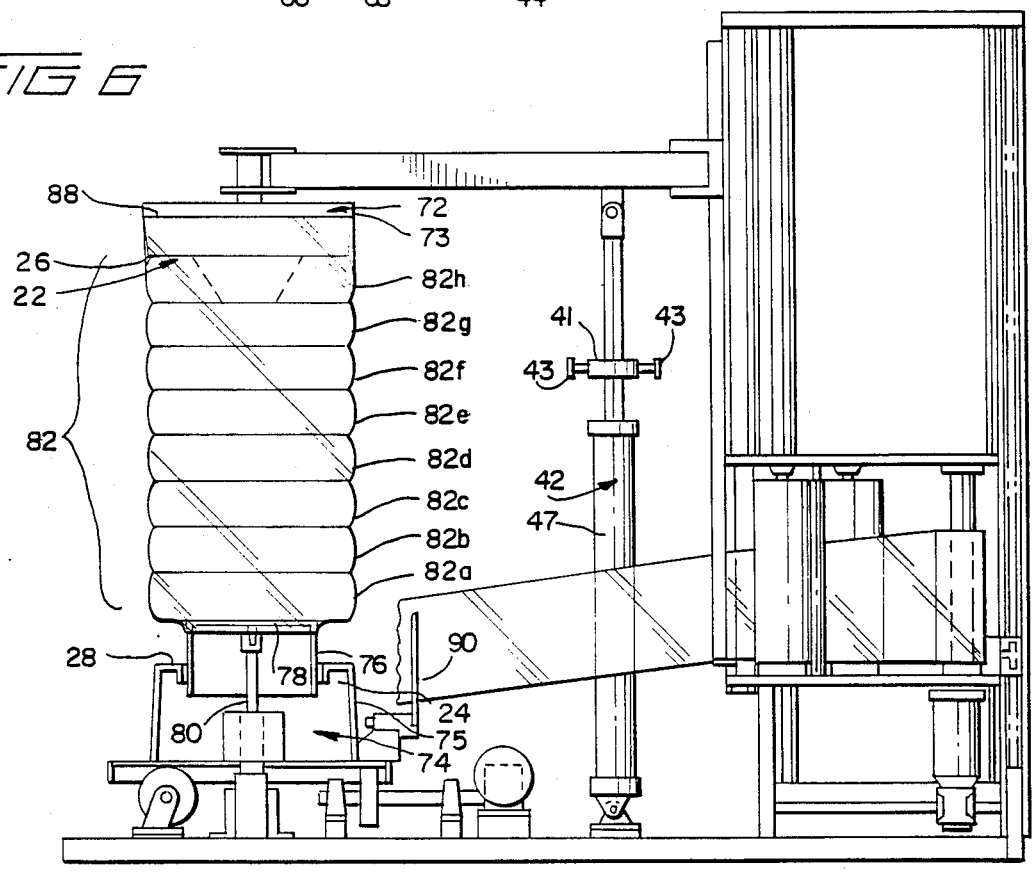

It is preferable that the mandrel means includes an inner ejector means for moving relative to the mandrel means and for removing the wrapped load from the mandrel means. As shown in FIG. 6, the ejector means includes an ejector drum 76 mounted radially inside lower platen 24 and lower mandrel 74 having a upwardly facing surface 78 which engages the lower end of the stack of tires and which can be elevated by piston and cylinder 80 relative to lower platen 24 and lower mandrel 74 to elevate the wrapped stack of tires and its wrap of stretch film from lower platen 24 and lower mandrel 74.

It is preferable that the apparatus includes means for stopping the compression of each stack at the same position so that each stack is compressed to the same length in the longitudinal direction. As shown in FIG. 3, the means for stopping the compression is a clamp collar 41 which is clamped onto shaft 45 of piston and cylinder 42 through the use of screws 43.

In accordance with the present invention, there is provided a method of unitizing a load of tires stacked in a longitudinal direction. An embodiment of this method is shown sequentially in FIGS. 3–8.

As shown in FIG. 3, stack of tires 82 includes eight tires, **82*a*, 82*b*, 83*c*, 82*d*, 82*e*, 82*f*,82*g*, and 82*h* which are stacked in a longitudinal direction which is the vertical direction. It is preferable that the tires are stacked and are transported as a load of stacked tires to a wrapping position on stretch wrapping device 20** prior to wrapping. This may be done by an automatic or manual stacking system.

According to the present invention, the method includes compressing the stack of tires in the longitudinal direction between platens located adjacent the ends of the stack of tires. As shown in FIG. 3, a stack of tires 82 positioned on annular upwardly facing platen surface 28 of lower platen 24.

The lower sidewall of bottom tire **82*a* faces and is aligned with annular upwardly facing platen surface 28 of lower platen 24. The outer tread diameter of lower tire 82*a* is substantially the same diameter as the outer diameter of platen surface 28 and mandrel surface 75**. A tolerance of a few inches is usually acceptable so long as the difference in diameter does not result in tire collapse or an unsatisfactory cover of the tire sidewalls at the ends of the stack.

The upper sidewall of upper tire **82*h* faces and is aligned with annular downwardly facing platen surface 26 of upper platen 22. The outer tread diameter of upper tire 82*h* is substantially the same diameter as the outer diameter of platen surface 26 and mandrel surface 73**. A tolerance of a few inches is usually acceptable so long as the difference in diameter does not result in tire collapse or an unsatisfactory cover of the tire sidewalls at the ends of the stack. Accordingly, the present method and apparatus allows parts of the load to be covered by the web of stretch film which were previously covered by the platens.

As shown in FIG. 9, lower platen 24 with lower mandrel 74 is used with 29 inch diameter tires 82*a* and 82*b*. If different diameter tires are to wrapped, it is preferable to use a lower platen and mandrel which are sized accordingly. As shown in FIG. 9, lower platen 124 with lower mandrel 174 are positioned relative to a stack of 24 inch diameter tires 182*a* and 182*b* so that the outer diameter of mandrel of 174 is substantially the same diameter as the outside diameter of tires 182*a* and 182*b*. Similar adjustments can be made to upper platen 22 and upper mandrel 72.

Figure 4:
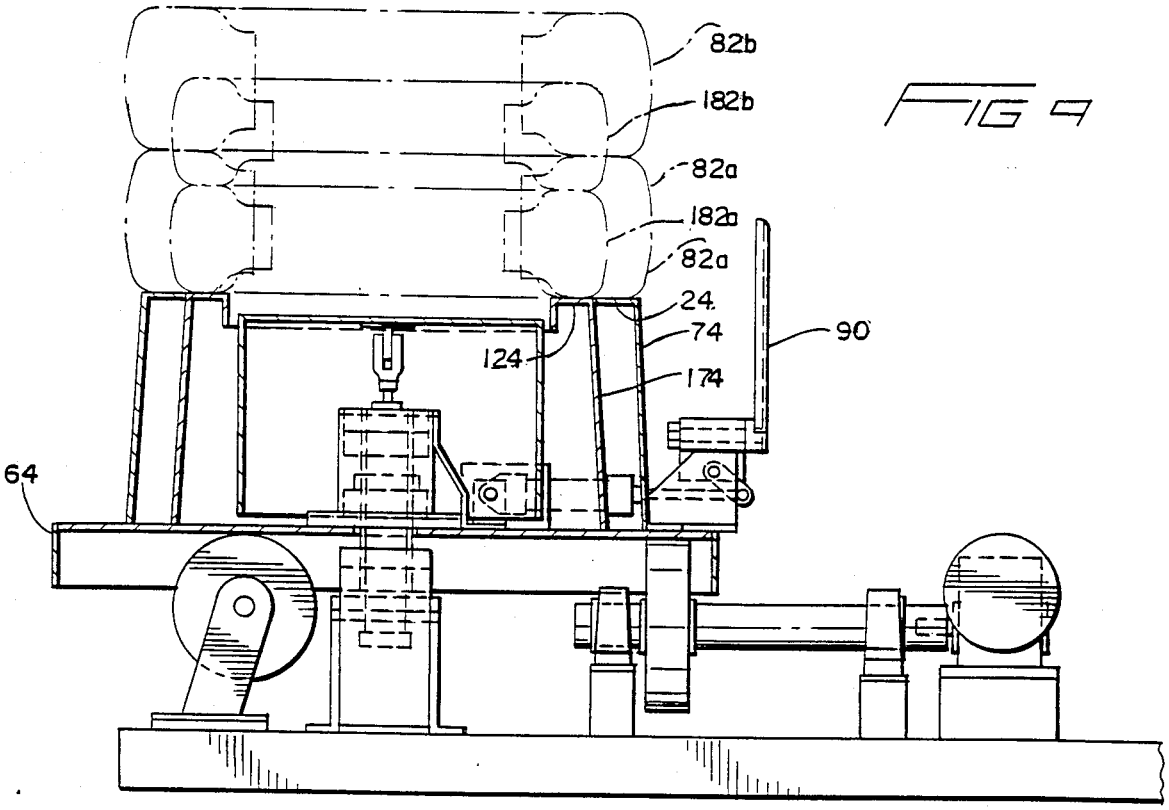
FIGS. 3–8 are side elevational views of an apparatus for unitizing a stack of tires incorporating the teachings of the present invention and showing the steps of a method incorporating the teaching of the present invention.

In FIG. 3, stack of tires 82 is shown in its normal uncompressed condition. In FIG. 4, stack of tires 82 is shown in a compressed condition. During the compressing step in which stretch wrapping device 20 moves between the position shown in FIG. 3 and FIG. 4, piston and cylinder 42 are contracted and horizontal beam 36 slides down post 38 while kept in a horizontal position. As a result, the end of horizontal beam 36 which is connected to upper platen 22 descends from the position shown in FIG. 3 to the position shown in FIG. 4, compressing stack of tires 82 in a longitudinal direction.

Central frusto-conical portion 30 of upper mandrel 22 helps to center and keep stack of tires 82 centered in the wrapping position. Clamp collar 41 proceeds downward with the piston 45 until it encounters and is stopped by the end wall of cylinder 47. As a result of using clamp collar 41 or similarly functioning structure, each stack of tires is compressed to the same length in the longitudinal direction. This permits the wrapped stacks to be uniform and ultimately form a more predictable and compact truckload of tires.

According to the present invention, the method includes dispensing a web and stretching the web along the direction in which it is dispensed. As shown in FIG. 4, web of stretch film 56 is dispensed and stretched by driving it to the left and stretching it with prestretch rollers 60 and 62. The stretching occurs because roller 62 is driven at a faster rate of speed than roller 60.

A leading end portion of the web is held so that it rotates with the stack of tires. As shown in FIG. 4, web 56 includes leading end portion 86. Leading end 86 is tucked into the stack of tires 82 or turntable assembly 64, or is clamped to the turntable so that the web of stretch film 56 can be wrapped around the load of tires 82 as shown in FIG. 5.

According to the present invention, the method includes positioning mandrels adjacent the ends of the stack of tires. As shown in FIG. 5, lower mandrel 74 is positioned adjacent one end of the stack of tires 82 when the stack of tires is positioned on lower platen 24. Accordingly, lower mandrel 74 is positioned adjacent bottom tire 82*a*. Upper mandrel 72 is positioned adjacent top tire 82*h* at the other end of the stack of tires when upper platen 22 is dropped to compress the stack of tires 82.

According to the present invention, the method includes rotating the stack of tires relative to the web dispenser about an axis in the longitudinal direction, wrapping the stretched web around and onto the compressed stack of tires and the mandrels, forming a tube from the web which extends in the longitudinal direction beyond the stack of tires and on the mandrels.

As shown in FIG. 5, stack of tires 82 is rotated relative to the film web dispenser supported by film roll carriage 46. Turntable 64 is driven about a vertical axis passing through axle 36 through the use of motor 70 and drive wheel 68. As turntable 64 rotates, it wraps stretch film 56 around stack of tires 82. The web of stretch film 56 may be wide enough to cover a portion of mandrel surface 73 of upper mandrel 72, a portion of mandrel surface 75 of lower mandrel 74, and the load that is to be wrapped.

Alternatively, as shown in FIG. 5, the web may be narrower than the height of the stack of tires 82, and film roll carriage 46 can be movably positioned in the vertical direction to spirally wrap the compressed stack of tires 82 as well as a portion of mandrel surface 75 of lower mandrel 74 and a portion of mandrel surface 73 of upper mandrel 72. As shown in FIG. 5, the web of stretch film 56 forms a tube 88 which extends in the longitudinal direction beyond stack of tires 82 and onto upper mandrel 72 and lower mandrel 74. The tires and mandrels are wrapped so that the upper edge 88*a* of tube 88 is below the upper edge 73*a* of surface 73, and the lower edge 88*b* of tube 88 is above lower edge 75*b* of surface 75. The mandrel surfaces 73 and 75 have a sufficient extent in the longitudinal direction that the portions of tube 88 which are wrapped on mandrel surfaces 73 and 75 have an extent sufficient to cover the desired portion of the tire sidewalls at the ends of the stack of tires 82 without extending beyond upper and lower edges 73*a* and 75*b* of respective mandrel surfaces 73 and 75.

According to the present invention, the method includes separating the mandrels from the web and stack of tires and collapsing the web from the mandrel onto the end of the stack of tires, covering the sidewalls of the tires at the ends of the stack. It is preferable that the separating step include moving an ejector positioned within one of the mandrels, relative to said one of the mandrels, pushing the stack of tires away from said one of the mandrels in the longitudinal direction.

As shown in the movement between FIGS. 5 and 6, ejector drum 76 is extended in the upward direction by piston cylinder 80, relative to lower platen 24 and lower mandrel 74. Simultaneously, piston and cylinder 42 is deactivated to release the compressive force it previously exerted on the stack of tires 82. Upper mandrel 72 continues to bear on the stack due to the force of gravity, but is easily moved by ejector drum 76 and stack of tires 88 while helping to maintain the stack in position on ejector drum 76. As ejector drum 76 is extended in the upward direction, the bottom of the tube 88 of the web of stretch film 56 collapses inwardly and covers the sidewall of the tire adjacent mandrel 74, namely, the lower sidewall of bottom tire 82*a*.

Figure 7:
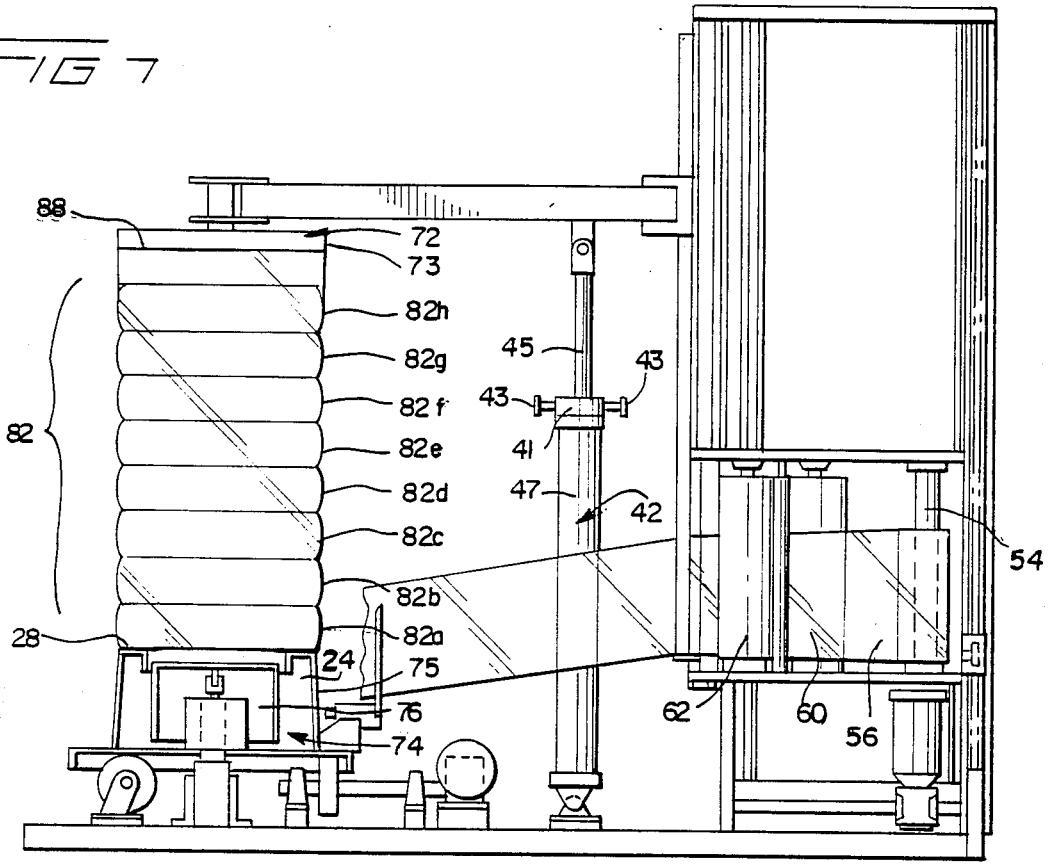

In the movement between FIGS. 6 and 7, ejector drum 76 is retracted into the center of lower platen 24 and lower mandrel 74. Annular upwardly facing surface 28 of platen 24 restrains the portion of the tube 88 of stretch film 56 which covers the bottom of bottom tire 82*a* so that ejector drum 76 is completely separated from tube 88 of stretch film 56.

Figure 8:
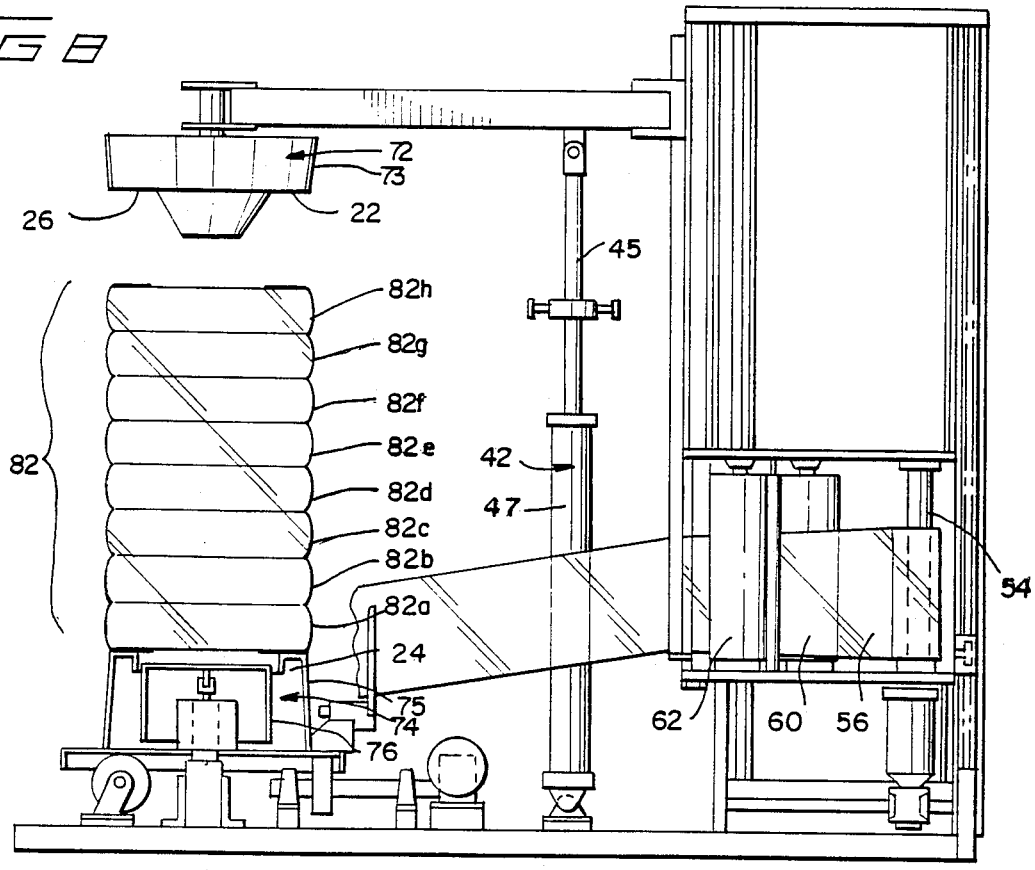

Upper mandrel 72 is separated from tube 88 of stretch film 56 by extending piston and cylinder 42 as shown in the movement between FIGS. 7 and 8. Upper mandrel 72 is lifted away from stack of tires 82. This allows tube 88 of stretch film 56 to slide off mandrel 72 and collapse onto the upper end of the stack of tires 82, covering the sidewall of the tire adjacent mandrel 72, namely, the top sidewall of top tire 82*h*. During the separating steps, the tensioned stretch film which has been wrapped to form a tube 88 surrounding stack of tires 82, holds stack of tires 82 together in the compressed state even though the compressing platens 22 and 24 are removed from the ends of the stack of tires 82.

Figure 1:
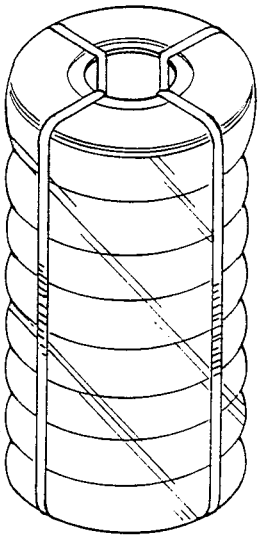
FIG 1 PRIOR ART
FIG. 1 is a perspective view of a stack of tires which have been unitized according to a conventional method.
Figure 2:
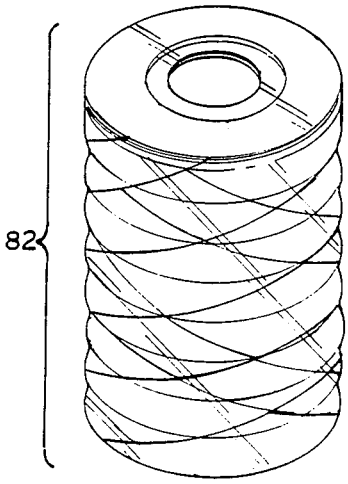
FIG. 2 is a perspective view of a stack of tires which have been unitized according to the teachings of the present invention.

The resulting compressed and wrapped stack of tires shown in FIG. 2 takes up less space than the unwrapped tires or the banded tires shown in FIG. 1. This stack takes up less volume and allow more tires to be transported in a single truck, reducing the cost of transporting tires. In addition, the present invention keeps the tires clean and overcomes the other drawbacks associated with conventional methods and apparatus for wrapping stacks of tires. As shown in FIG. 9, clamps 90 can be used to hold the leading end 86 of the stretch film during wrapping and make the wrapping cycle completely automated. This method and apparatus may be combined with a wipe down and cutting device such as that shown in U.S. Pat. No. 4,735,033.

Additional advantages and modifications will readily occur to those skilled in the art. The invention in its broader aspects is, therefore, not limited to be specific details, representative apparatus and illustrative examples shown and described. Accordingly, departures may be made from such details without departing from the spirit or scope of the general inventive concept as defined by the appended claims and their equivalents.

What is claimed is:

1. A method of unitizing a load of tires stacked in a longitudinal direction comprising:

compressing the stack of tires in the longitudinal direction between platens located adjacent the ends of the stack of tires;

dispensing a web;

stretching the web along the direction in which it is dispensed;

positioning mandrels adjacent the ends of the stack of tires;

rotating the stack of tires relative to the web dispenser about an axis in the longitudinal direction, wrapping the stretched web around and onto the compressed stack of tires and the mandrels, forming a tube from the web which extends in the longitudinal direction beyond the stack of tires and on the mandrels; and separating the mandrels from the web and stack of tires and collapsing the web form the mandrels onto the ends of the stack of tires covering the sidewalls of the tires at the ends of the stack.

2. The method of claim 1 wherein the separating step includes moving an ejector positioned within one of the mandrels relative to said one of the mandrels, pushing the stack of tires away from said one of the mandrels in the longitudinal direction.

3. The method of claim 1 wherein the longitudinal direction is the vertical direction and the mandrels include an upper mandrel positioned above the stack of tires and a lower mandrel positioned below the stack of tires.

4. The method of claim 3 wherein the separating step includes removing an ejector positioned within the lower mandrel relative to the lower mandrel, pushing the stack of tires away from the lower mandrel in the longitudinal direction.

5. The method of claim 4 wherein the separating step includes moving the upper mandrel and the ejector upwardly in the longitudinal direction to separate the lower mandrel from the tube.

6. The method of claim 5 wherein the upper mandrel is moved upwardly in the longitudinal direction relative to the stack of tires to separate the lower mandrel from the tube subsequent to moving the upper mandrel and the ejector to separate the lower mandrel from the tube.

7. The method of claim 1 including stopping the compression of each stack of tires at the same position so that each stack is compressed to the same length in the longitudinal direction.

8. The method of claim 1 wherein the outer diameter of the mandrels is substantially the same diameter as the outer diameter of the tires.

9. The method of claim 1 wherein the outer diameter of the platens is substantially the same diameter as the outer diameter of the tires.

10. The method of claim 1 wherein the outer diameter of the mandrels and the platens are substantially the same diameter as the outer diameter of the tires.

11. Apparatus for unitizing a load of tires stacked in a longitudinal direction comprising:

means for dispensing a web;

means for stretching the web along the direction in which it is dispensed;

means for rotating the stack of tires relative to the web dispensing means about an axis in the longitudinal direction, wrapping the stretched web around and onto the stack of tires and forming a tube from the web, with portions of the tube extending in the longitudinal direction beyond the ends of the stack of tires; and mandrel means positionable adjacent the ends of the stack of tires for supporting and compressing the stack of tires in the longitudinal direction, for supporting the portions of the tube which extend in the longitudinal direction beyond the ends of the stack of tires during wrapping, and for subsequently moving relative to the tube and the stack of tires to allow the tube to collapse on the ends of the stack of tires, covering the sidewall of the tires at the ends of the stack.

12. The apparatus of claim 11 wherein the mandrel means includes mandrel surfaces extending generally in the longitudinal direction and tapering convergently toward the stack of tires.

13. The apparatus of claim 11 wherein the mandrel means includes an inner ejector means for moving relative to the mandrel means and for removing the wrapped stack of tires from the mandrel means.

14. The apparatus of claim 11 wherein the longitudinal direction is the vertical direction and the mandrel means include an upper mandrel and a lower mandrel.

15. The apparatus of claim 14 wherein the upper mandrel includes a downwardly facing platen surface and a mandrel surface extending generally in the vertical direction, and the lower mandrel includes an upwardly facing platen surface and a mandrel surface extending generally in the vertical direction.

16. The apparatus of claim 15 wherein the upper mandrel includes a central mandrel portion for centering the stack of tires.

17. The apparatus of claim 11 including means for stopping the compression of each stack of tires at the same position so that each stack is compressed to the same length in the longitudinal direction.

18. The apparatus of claim 11 wherein the outer diameter of the mandrel means is substantially the same diameter as the outer diameter of the tires.

19. The apparatus of claim 15 wherein the outer diameter of the platen surfaces are substantially the same diameter as the outer diameter of the tires.

20. The apparatus of claim 15 wherein the outer diameter of the mandrel surface and the platen surface substantially the same diameter as the outer diameter of the tires.

* * * * *